US005474869A

United States Patent [19]

Tomita et al.

[11] Patent Number: 5,474,869

[45] Date of Patent: Dec. 12, 1995

[54] TONER AND METHOD OF DEVELOPING

[75] Inventors: Masami Tomita; Kohichi Katoh, both of Numazu; Tomoe Hagiwara, Shizuoka; Koji Suzuki, Yokohama; Shigekazu Enoki, Kawasaki; Naoki Iwata, Tokyo; Motoi Orihara; Shinichi Kuramoto, both of Numazu, all of Japan

[73] Assignee: Ricoh Company, Ltd., Tokyo, Japan

[21] Appl. No.: 316,071

[22] Filed: Sep. 30, 1994

Related U.S. Application Data

[60] Continuation of Ser. No. 128,048, Sep. 27, 1993, abandoned, which is a division of Ser. No. 691,348, Apr. 25, 1991, abandoned.

[30] Foreign Application Priority Data

| | | | |
|---|---|---|---|
| Apr. 26, 1990 | [JP] | Japan | 2-113558 |
| Jul. 7, 1990 | [JP] | Japan | 2-179923 |
| Feb. 1, 1991 | [JP] | Japan | 3-033735 |

[51] Int. Cl.[6] ..... G03G 13/08; G03G 9/08

[52] U.S. Cl. ..... 430/102; 430/111; 430/903

[58] Field of Search ..... 430/106.6, 111, 430/903, 102

[56] References Cited

U.S. PATENT DOCUMENTS

| | | | |
|---|---|---|---|
| 4,886,725 | 12/1989 | Tanaka et al. | 430/106.6 |
| 4,985,327 | 1/1991 | Sakashita et al. | 430/106.6 |
| 5,009,973 | 4/1991 | Yoshida et al. | 430/45 |
| 5,172,169 | 12/1992 | Takashima et al. | 355/246 |
| 5,220,383 | 6/1993 | Enoki et al. | 355/246 |
| 5,239,344 | 8/1993 | Enoki et al. | 355/259 |
| 5,245,391 | 9/1993 | Suzuki et al. | 355/246 |
| 5,286,918 | 2/1994 | Iwata et al. | 118/653 |
| 5,311,263 | 5/1994 | Suzuki et al. | 355/251 |
| 5,315,061 | 5/1994 | Suzuki et al. | 118/651 |
| 5,339,141 | 8/1994 | Suzuki et al. | 355/246 |

*Primary Examiner*—Roland Martin

*Attorney, Agent, or Firm*—Cooper & Dunham

[57] ABSTRACT

A toner comprising a binder resin and a coloring agent, with an aggregation degree of 5 to 60%, and an absolute value of Q/M measured by the suction method of 2 to 30 μC/g for use in (1) an image formation method in which electric charges are selectively held on the surface of a development roller to form a number of closed micro fields near the surface of the development roller, a non-magnetic one-component type developer comprising toner, with addition of an auxiliary agent thereto when necessary, is supplied onto the development roller, the developer is held on the surface of the development roller by the micro fields, and latent electrostatic images are developed to visible toner images, and (2) an image formation method in which the surface of a developer-bearing member having a chargeable and photoconductive surface is charged, the charged surface is selectively exposed to light for form a number of micro fields near the developer-bearing member, a non-magnetic one-component type developer comprising toner, to which auxiliary agents may be added when necessary, is supplied onto the development roller, the developer is held on the surface of the development roller by the micro fields, and latent electrostatic images are developed to visible images by the developer.

4 Claims, 3 Drawing Sheets

TONER AND METHOD OF DEVELOPING

This application is a continuation of Ser. No. 128,048, filed Sep. 27, 1993, now abandoned, which is a continuation of Ser. No. 691,348, filed Apr. 25, 1991, now abandoned.

BACKGROUND OF THE INVENTION

Field of the Invention

The present invention relates to a toner which constitutes a non-magnetic one-component type developer for developing latent electrostatic images to visible images, which latent electrostatic images are formed on a latent-electrostatic-image-bearing member and developed to visible images in a development zone where the latent-electrostatic-image-bearing member is positioned in vicinity to a rotatable development roller which carries thereon the non-magnetic one-component type developer. To the toner or the non-magnetic one-component type developer, auxiliary agents may be added when necessary.

Discussion of the Background

In image formation apparatus such as electrophotographic copying machines, printers and facsimile apparatus, in which latent electrostatic images are formed on a latent-electro-static-image bearing member and developed to visible image to record the visible images, a dry type development apparatus which employes a powder-like developer is widely used.

As such a powder-like developer, there are conventionally known a two-component type developer comprising a toner and a carrier, and a one-component type developer comprising a toner, without containing a carrier.

In a two-component development method using the above two-component type developer, relatively stable recorded images can be obtained. However, the two-component type development method has the shortcomings that the deterioration of the carrier with time, and variations in the mixing ratio of the toner and the carrier are apt to occur, so that the maintenance of the image formation apparatus using the two-component type developer is complicated, and the size of the apparatus is comparatively large.

From the viewpoint of the above-mentioned shortcomings of the two-component development method, the one-component type development method free from such shortcomings attracts attention.

There are two types of one-component type developers used in the one-component type development method. One is a one-component type developer consisting of a toner, and another is a one-component type developer comprising a toner and an auxiliary agent added thereto, but containing no carrier. Furthermore, there are two types of the toners: a magnetic toner comprising toner particles in which finely-divided magnetic particles are incorporated, and a non-magnetic toner comprising toner particles in which such magnetic particles are not incorporated.

The magnetic particles used in the above are generally opaque. Therefore, if colored images including full-colored images and multi-colored images are formed by use of a magnetic toner, the developed visible images are not clear, so that clear colored images cannot be obtained. Therefore it is preferable to employ a non-magnetic one-component type developer for obtaining such colored images.

In a development apparatus using a one-component type developer, the developer is carried on a development roller and brought into contact with a latent-electrostatic-image bearing member in a development zone where the development roller is positioned in close vicinity to the latent-electrostatic-image bearing member directed thereto, so that the latent electrostatic images formed on the latent-electrostatic-image-bearing member are developed to visible images. In such a development apparatus, in order to obtain visible images with high quality and a predetermined image density, it is required to transport a relatively large amount of a sufficiently charged toner to a predetermined polarity into the development zone.

In the case where a magnetic toner is employed, the above requirement can be relatively easily satisfied because the one-component type developer is magnetically held on a development roller because the magnetic force of an inner magnet built in the development roller can be utilized for holding the developer.

However, when a non-magnetic one-component type developer is employed, the developer cannot be held on the development roller by the magnetic force as mentioned above. Therefore the above requirement cannot be easily satisfied.

Various countermeasures for the above problems have been proposed. For instance, in Japanese Laid-Open Patent Application 61-42672, there is proposed a method in which a dielectric layer is formed on a development roller, and a developer supply member constructed of a sponge roller is brought into pressure contact with the development roller, so that the development roller and the developer supply member are triboelectrically charged to opposite polarities, and a non-magnetic toner which is charged to a polarity opposite to the polarity of the dielectric layer of the development roller is electrostatically deposited on the dielectric layer of the development roller, and the thus electrically charged one-component type developer is transported into a development zone. Even this method, however, cannot increase the intensity of an electric field formed near the dielectric layer to the extent that a sufficiently large amount of the toner can be held on the surface of the development roller. The result is that the amount of the developer that can be transported into the development zone is insufficient so that it is difficult to obtain visible images with high density.

In another conventional method, an electric field is applied between a development roller and a developer supply member in such a direction that a non-magnetic toner is electrostatically transferred toward the development roller. Even by this method, it is still difficult to hold a sufficient amount of a toner on the development roller.

The following toner supply members are known: an electroconductive foamed member with a resistivity of $10^2$ to $10^6$ Ω·cm (Japanese Laid-Open Patent Application 60-229057), an elastic member with a skin layer (Japanese Laid-Open Patent Application 60-229060) and a fur brush (Japanese Laid-Open Patent Application 61-42672).

The following development rollers are also known: a metallic roller with undulations on the surface thereof (Japanese Laid-Open Patent Application 60-53976), a roller covered with an insulating layer (Japanese Laid-Open Patent Application 55-46768), a roller covered with a material with a medium resistivity (Japanese Laid-Open Patent Application 58-13278) and an electrode roller comprising an insulating member and an electroconductive surface (Japanese Laid-Open Patent Application 53-36245).

In a development apparatus utilizing a non-magnetic one-component type developer, by use of the sponge roller in Japanese Laid-Open Patent Application 60-229057, the elastic roller in Japanese Laid-Open Patent Application 62-229060, or the fur brush in Japanese Laid-Open Patent Application 61-52663, a toner is triboelectrically charged by the friction between the toner and such a toner supply member, and is then electrostatically deposited in the form of a layer on the development roller by bringing the toner into contact with the development roller, with the thickness of the toner layer being regulated by a toner-layer-thickness regulating member such as a blade, and latent electrostatic images formed on a photoconductor are developed to visible toner images. As the materials for such development rollers, there are varieties of materials, including insulating materials, materials with a medium resitivity and layered materials.

In the development systems disclosed in the above references, the toner is deposited on a development roller by the friction between a toner supply member and the development roller. However since the friction is performed by a member on which the toner is deposited, it is difficult to obtain a sufficient triboelectric charging. The result is that the amount of the toner deposited on the development roller eventually becomes insufficient. Furthermore, when a colored toner and a black toner are compared, the amount of deposition of a black toner necessary for obtaining a sufficient density is about 0.4 to 0.5 mg/cm$^2$, while the amount of deposition of a colored toner necessary for obtaining a sufficient density is about 1.5 to 2 times the amount of deposition of the black toner. The fact that such a large amount of deposition is necessary in the case of a non-magnetic one-component developer is one of the shortcomings of the non-magnetic one-component developer.

Furthermore, Japanese Laid-Open Patent Application 54-51841 proposes the technique of applying corona charges to the surface of a development roller after a non-magnetic one-component type developer on the development roller is scraped off when the developer has passed through a development zone, and the non-magnetic one-component type developer is electrostatically deposited on the development roller by a developer supply member. However, the amount of the developer carried on the development roller cannot be increased. Accordingly a large amount of the developer cannot be transported into the development zone by this technique.

Under such circumstances, in Japanese Patent Publication 41-9475, there is proposed a development method utilizing a non-magnetic one-component type toner, in which a toner supply member carrying a thin toner layer thereon is disposed in close vicinity to a latent-electrostatic-image-bearing member, and only the toner is caused to fly onto the latent electrostatic images. In this method, the toner is held on a web with an appropriate adhesiveness, or on a pre-charged film sheet, and the length of such a web or film sheet is limited. Thus this method is not suitable for continuous copying or printing.

If a toner supporting member is made in the form of an endless belt suitable for repeated use, the above problem will be solved. As a matter of fact, such a method using a non-magnetic one-component type toner is proposed in Japanese Laid-Open Patent Application 60-229065. In this method, an elastic, toner-layer-thickness regulating member is brought into contact with a toner-bearing roller to form a toner layer with a uniform thickness, and latent electrostatic images formed on a photoconductor are developed with the toner under application of an A.C. or D.C. development bias voltage. In this method, however, the formed toner layer is substantially a single layer, so that it is difficult to obtain images having high density and high contrast. Furthermore, in Japanese Laid-Open Patent Application 50-30537, a development apparatus utilizing a pulse bias system is disclosed in an attempt to improve image quality. However, it is difficult to obtain images with high density and high contrast even by this method.

Japanese Laid-Open Patent Application 47-12635 and Japanese Laid-Open Patent Application 50-10143 disclose developer-bearing members with minute insulating patterns and electroconductive patterns on the surface thereof. In these developer-bearing members, the peaks and valleys of toner corresponding to the minute patterns are formed utilizing minute electric fields, whereby toner is deposited in such a manner as to correspond to the potential level of the latent electrostatic images. The structure of such developer-bearing members with the minute patterns is complex and therefore the production cost is high.

In order to solve these conventional problems, the inventors of the present invention previously proposed an image formation method in which a one-component type developer comprising a non-magnetic toner, when necessary with addition of auxiliary agents thereto, is supplied to the surface of a development roller which is rotatably driven to transport the developer into a development zone where a latent-electrostatic-image-bearing member is directed to the development roller, so that the latent electrostatic images on the latent-electrostatic-image-bearing member are developed to visible images, characterized in that a number of micro electric fields are formed near the surface of the development roller by selectively causing the surface of the development roller to support electric charges, the charged toner is attracted by these closed electric fields to deposit the toner on the development roller, thereby developing the latent electrostatic images to visible toner images.

This method has many advantages over the conventional methods, including the advantage that the intensity of the electric field near the development roller can be significantly increased in comparison with the case where the conventional methods are employed, and therefore a large amount of sufficiently charged toner can be transported into the development zone by the development roller, since a number of micro fields are formed near the surface of the development roller. In the method utilizing the micro fields, however, if conventional toners are employed as they are, it is extremely difficult to form two or more toner layers on the development roller in a stable manner, and the toner layer formed thereon eventually becomes thin and accordingly the amount of the toner to be used for development is decreased. The result is that the obtained image density is low, non-uniform development occurs, fogging takes place in the image, or the contrast of the images is decreased. Furthermore, a so-called filming phenomenon in which a thin layer of toner is formed on the development roller occurs, which reduces the effect of the micro fields. In the end, the amount of the toner held by the development roller is significantly decreased and it becomes difficult to supply a sufficient amount of the toner to the latent electrostatic images for producing images with high density and high contrast.

SUMMARY OF THE INVENTION

It is therefore an object of the present invention to provide a toner, which is substantially a non-magnetic one-component type developer, free from the above-mentioned drawbacks, capable of forming two or more toner layers uniformly in a stable manner on a development roller, without the problem of the occurrence of the filming phenomenon, and capable of yielding high quality images with high image density and high contrast over an extended period of time, suitable for use in (1) an image formation method in which a number of micro fields are formed near the surface of a development roller by causing the surface of the development roller to selectively hold electric charges, a non-magnetic one-component type developer comprising toner, to which auxiliary agents may be added when necessary, is supplied onto the development roller, the developer is held on the surface of the development roller by the micro fields, and latent electrostatic images are developed to visible images by the developer, and (2) an image formation method in which a developer-bearing member having a chargeable and photoconductive surface is charged, the charged surface is selectively exposed to light for form a number of micro fields near the developer-bearing member, a non-magnetic one-component type developer comprising toner, to which auxiliary agents may be added when necessary, is supplied onto the development roller, the developer is held on the surface of the development roller by the micro fields, and latent electrostatic images are developed to visible images by the developer.

The above object of the present invention can be achieved by a toner comprising a binder resin and a coloring agent, with a specific aggregation degree and a specific charge quantity.

DETAILED DESCRIPTION OF THE PREFERRED EMBODIMENTS

Figure 1:
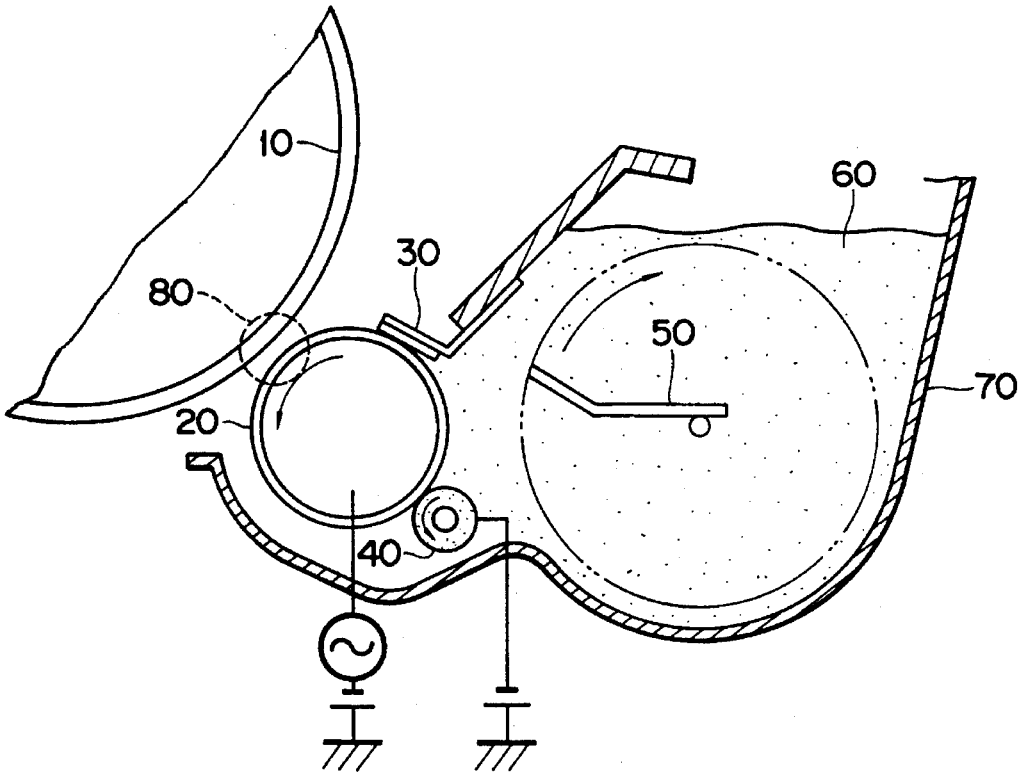
FIG. 1 is a schematic cross-sectional view of a development apparatus including a development roller on which a number of micro fields are formed, which is useful to carry out the present invention.

The toner according to the present invention, which is substantially a non-magnetic one-component developer for development latent electrostatic images to visible toner images and which is hereinafter referred to as the toner for simplicity, comprises a binder resin and a coloring agent, with an aggregation degree of 5 to 60%, more preferably 5 to 30%, and an absolute value of Q/M measured by a suction method of 2 to 30 μC/g, more preferably 5 to 20 μC/g, suitable for use in (1) an image formation method in which electric charges are selectively held on the surface of a development roller to form a number of closed micro fields near the surface of the development roller, a non-magnetic one-component type developer comprising toner, to which an auxiliary agent may be added thereto when necessary, is supplied onto the development roller, the developer is held on the surface of the development roller by the micro fields, and latent electrostatic images are developed to visible toner images by the developer, which is hereinafter referred to as the first image formation method, and (2) an image formation method in which a developer-bearing member having a chargeable and photoconductive surface is charged, the charged surface is selectively exposed to light to form a number of micro fields near the developer-bearing member, a non-magnetic one-component type developer comprising toner, to which auxiliary agents may be added when necessary, is supplied onto the development roller, the developer is held on the surface of the development roller by the micro fields, and latent electrostatic images are developed to visible images by the developer, which is hereinafter referred to as the second image formation method.

When the aggregation degree and the Q/M value measured by the suction method are in the above-mentioned respective ranges, the movement of the toner along the development roller is optimized, and two or more toner layers can be uniformly and stably formed on the development roller. Furthermore, the filming phenomenon of the toner on the development roller, and the fogging of images at the time of development can be minimized.

However, when the aggregation degree of the toner is smaller than 5%, the toner scatters from the development roller or the fogging is apt to occur. When the aggregation degree exceeds 60%, it is difficult to form multiple toner layers by the micro fields, so that the development efficiency, that is, the ratio of the toner on the development roller, used for development, to the toner not used for development is decreased. As a result, the obtained image density is decreased and tends to become non-uniform.

In the present invention, the aggregation degree of the toner is measured by the following procedure, using a commercially available powder tester made by Hosokawa Micron Co., Ltd.:

The following component parts are set on a vibration table: (a) a vibrochute, (b) a packing, (c) a space ring, (d) three types of sieves (upper, middle and lower sieves), and (e) a holding bar. These are fixed by knob nuts, and the vibration table is operated, and the measurement is carried out under the following conditions:

(1) Upper sieve with a mesh size of 75 μm (2) Middle sieve with a mesh size of 45 μm (3) Lower sieve with a mesh size of 22 μm (4) Vibration scale: 1 mm (5) Amount of test sample: 10 g (6) Vibration time: 30 seconds After the measurement, the aggregation degree was determined in accordance with the following formula:

$$\frac{\text{Amount of Powder Remained in Upper Sieve}}{\text{Amount of Test Sample}} \times 100 \quad \text{(a)}$$

-continued $$\frac{\text{Amount of Powder Remained in Middle Sieve}}{\text{Amount of Test Sample}} \times 100 \times 3/5 \quad \text{(b)}$$

$$\frac{\text{Amount of Powder Remained in Lower Sieve}}{\text{Amount of Test Sample}} \times 100 \times 1/5 \quad \text{(c)}$$

The total of the above (a), (b) and (c), that is, (a)+(b)+((c), is the aggregation degree (%).

In the present invention, the absolute value of Q/M of the toner on the development roller, measured by the suction method, is 2 to 30 μC/g, more preferably 5 to 20 μC/g.

When the Q/M value is in the above-mentioned range, multiple toner layers can be formed on the development roller in a stable manner, and the scattering of the toner during the development process, the fogging of the images, and the reduction of image density can be minimized.

When the Q/M value is less than 2 μC/g, the scattering of the toner from the development roller and the fogging of images are apt to occur, while when the Q/M value is more than 30 μC/g, the development efficiency is decreased and the reduction in image density and the non-uniformity or unevenness of image density are apt to occur.

In the present invention, the measurement of the Q/M of the toner on the development roller by the suction method is carried out as follows:

The toner deposited on the development roller is sucked through a Faraday gauge (not shown) provided with a filter layer on an outlet side, and the amount and the charge quantity of the toner trapped within the Faraday gauge are measured, from which the Q/M is calculated.

When the toner is employed in the previously mentioned second image formation method, it is preferable that the toner have a specific volume resistivity of 10.2 to 11.81 log Ω·cm. In this case, when the specific volume resistivity is less than 10.2 log Ω·cm, the leakage of electric charges between the developer-bearing member and the photoconductor is apt to occur, and an excessive amount of the toner is employed for development under high temperatures and humidities, and the reduction in image transfer, the non-uniformity of image density, and the fogging of images tend to occur. On the other hand, when the specific volume resistivity is more than 11.8 log Ω·cm, the toner on the developer-bearing member is apt to charged up in the course of the stirring for an extended period of time, so that it is not easy to form multiple toner layers in a stable manner. As a result, the image density is apt to decrease.

The specific volume resistivity is measured as follows.

(1) A pellet with a diameter of 4 cm is formed from 3 g of toner particles, for instance, by use of a commercially available electrically-driven press machine made by Maekawa Testing Co., Ltd., with application of a pressure of 6 t/cm$^2$ for one minute.

(2) The thus prepared pellet is set in a commercially available dielectric material testing machine (Trademark "TR-10C type, made by Ando Denki Co., Ltd.) and the specific volume resistivity is measured under the following conditions:

Frequency: 1 KHz

Ratio: 1/10$^9$ (Gr)

$R_0$: Electroconductivity at a zero-point measurement

R: Electroconductivity at equilibrium $$\text{Specific volume resistivity } (\Omega\cdot\text{cm}) = A\ (\text{cm}^2)/Gx \times I\ (\text{cm})$$

$$\because Gx = Gr \times (R - R_0)v$$

wherein A is the area of the electrode, and I is the thickness of the pellet. From the above, the specific volume resistivity (log Ω·cm) is obtained.

In the toner according to the present invention, any of binder resins employed in the conventional toners can be employed. More specifically, the following binder resins can be employed: styrene resins, such as polystrene, styrene-acrylic acid copolymer, styrene-methacrylic acid copolymer, styrene-acrylic acid ester copolymer, styrene-methacrylic acid ester copolymer, and styrene-butadiene copolymer; and other resins such as saturated polyester resin, unsaturated polyester resin, epoxy resin, phenolic resin, maleic acid resin, cumarinic acid resin, chlorinated paraffin, xylene resin, vinyl chloride resin, polypropylene, and polyethylene. These binder resins can be used alone or in combination. Of the above-mentioned binder resins, polystrene, styrene type resins, and epoxy resin are preferable for use in the present invention.

In the toner according to the present invention, any of coloring agents employed in the conventional toners can be employed. More specifically, the following coloring agents can be employed: carbon black, lamp black, iron black, ultramarine, Nigrosine dye, Aniline Blue, Calconyl Blue, Du Pont Oil Red, Quinoline Yellow, Methylene Blue Chloride, Phthalocyanine Blue, Phthalocyanine Green, Hansa Yellow G, Rhodamine 6C Lake, Chrome Yellow, Quinacridone, Benzidine Yellow, Malachite Green Hexalate, Oil Black, Azo Oil Black, Rose Bengale, monoazo dyes, disazo dyes, and trisazo dyes. These coloring agents can be used alone or in combination.

To the toner according to the present invention, charge controlling agents, fluidity-imparting agents, and lubricants can be added when necessary.

Examples of the charge controlling agents for use in the present invention include Nigrosine dyes, tertiary ammonium salts, basic dyes and amino-acid-containing polymers, which impart positive polarity to the toner; and chrome-containing monoazo dyes, chlorine-containing organic dyes, and metal salts of salicylic acid derivatives, which impart negative polarity to the toner.

Examples of the fluidity-imparting agents include inorganic oxides, such as $SiO_2$ and $TiO_2$, for which surfaces are subjected to a hydrophobic treatment, finely-divided inorganic particles, such as particles of SiC, and metal soaps, such as zinc stearate.

Examples of the lubricants include synthetic waxes such as low-molecular-weight polyethylene and polypropylene; vegetable waxes such as candellia wax, carnauba wax, rice wax and haze wax; animal waxes such as beeswax, lanolin, and whale wax; mineral waxes such as montan wax and ozocerite; and fatty waxes such as hardened castor oil, hydroxystearic acid, fatty acid amides, and phenol fatty acid esters.

Furthermore, in order to adjust the thermal characteristics, electrical characteristics and physical characteristics of the toner, varieties of plasticizers such as dibutyl phthalate and dioctyl phthalate, and resistivity-adjusting agents such as tin oxide, lead oxide and antimony oxide, can be added in addition of the above-mentioned auxiliary agents.

The toner according to the present invention constitutes a non-magnetic one-component type developer, to which any of the above-mentioned auxiliary agents may be added when necessary, and is useful for an image formation method in which electric charges are selectively held on the surface of a development roller to form a number of closed micro fields near the development roller, a toner is supplied onto the development roller to held the toner thereon by the closed micro fields, and latent electrostatic images are developed to visible toner images by the toner.

With reference to the accompanying drawings, the above-mentioned image formation method will now be explained.

FIG. 1 schematically shows a representative development apparatus including a development roller, which is useful for the above image formation method. In the figure, a toner 60 according to the present invention, which is held in a toner tank 70 is forced to move toward a toner supply member 40 such as a sponge roller or a fur brush by a stirring blade 50 serving as a toner-supply auxiliary member, so that the toner 60 is supplied to the toner supply member 40. When a development operation has been finished, a development roller 20 is rotated in the direction of the arrow, for example, at a rotation speed of 400 rpm, and reaches a portion in contact with the toner supply member 40 (here a sponge roller). The toner supply member 40 is rotated in the direction opposite to the rotary direction of the development roller 20, for example, at a rotation speed of 300 rpm, and applies electric charges to both the development roller 20 and the toner 60, so that the toner 60 is deposited on the development roller 20. The toner deposited on the development roller 20 is electrically charged and stabilized by a toner-layer-thickness regulation member 30 such as an elastic blade as the thickness of the toner layer on the development roller 20 is regulated to a predetermined thickness. The toner layer on the development roller 20 then reaches a development zone 80, where the latent electrostatic images are developed to visible toner images by either a contact development or a non-contact development. When necessary, a D.C. voltage, an A.C. voltage, a D.C.-superimposed A.C. voltage or a bias voltage, for instance, in the form of pulses, may be applied to the development roller 20 and the toner supply member 40 in order to optimize the quality of the developed images.

Figure 3A:
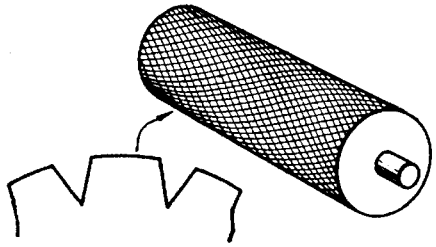
FIGS. 3(*a*) to 3(*c*) are the schematic cross-sectional views of the development roller for use in a development apparatus of the type shown in FIG. 1, in particular showing the surface conditions of the development roller in the course of the production thereof.
Figure 3B:
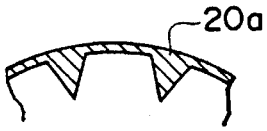
Figure 3C:
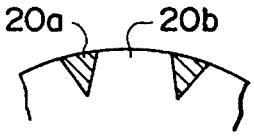

The mechanism of the toner deposition onto the development roller 20 of an electrode type will now be explained. An example of the development roller 20 is shown in FIGS. 3(*a*) to 3(*c*). As shown in the figures, the surface of the development roller is composed of a number of minute dielectric portions 20*a* and minute electroconductive portions 20*b* which are present in a mixed configuration. When the shape of each portion is circular, each of the portions has a diameter in the range of 10 to 500 μm, and these portions are arranged at random or in a certain order. It is preferable that the total area ratio of the dielectric portions 20*a* be in the range of 20 to 60% of the entire surface of the development roller 20.

Figure 2:
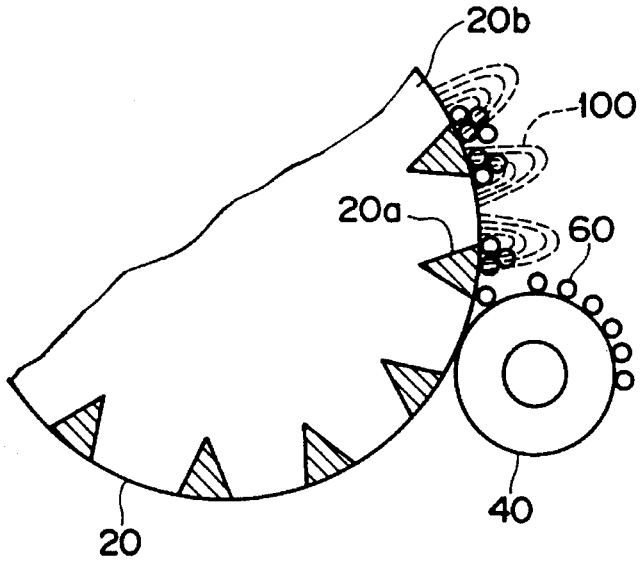
FIG. 2 is a schematic cross-sectional view of the development roller shown in FIG. 1, on which closed micro fields are formed.

The deposition of the toner 60 on the development roller 20 takes place as follows: After the development process, the development roller 20 is rotated in the direction of the arrow and comes into contact with the toner supply member 40. The toner which has not be used for development and remains on the development roller 20 is mechanically and/or electrically scraped off and the dielectric portions 20*a* are triboelectrically charged by the toner supply member 40. By this triboelectric charging, the electric charge of the development roller 20 and that of the toner 60 on the development roller 20 are made constant and initialized for the next development. The toner carried by the toner supply member 40 is triboelectrically charged and electrostatically deposited on the dielectric portions 20*a* of the development roller 20. At this moment, the polarity of the toner is opposite to the polarity of the charge of the photoconductor, and the same as the polarity of the charged dielectric portions of the development roller 20. The electric fields formed on the development roller 20 are closed micro fields 100 with a large electric field inclination as illustrated in FIG. 2, so that the toner can be deposited thereon in multiple layers. Because of the closed micro fields 100, the toner deposited on the development roller 20 is firmly attracted to the surface of the development roller 20 and is therefore hardly separated therefrom. The thickness of the toner layer formed on the development roller 20 is regulated by the toner-layer thickness regulating member 30, and the toner in the development zone 80 is placed in an electric field by which the toner is easily attracted to the photoconductor 10 for development of the latent electrostatic images formed thereon. As the materials for the components of the development apparatus, a large variety of materials can be employed. Examples of preferable materials, with the releasability from the toner and the durability taken into consideration, are shown below:

| Development Components | Materials | |
|---|---|---|
| Polarity of Toner | Positively chargeable toner | Negatively chargeable toner |
| Development Roller | Dielectric fluorine resins | Dielectric silicone resins |
| Toner Supply Member | Weakly positively chargeable urethane, and acrylic fur brushes | Weakly positively chargeable urethane and acrylic fur brushes |
| Toner Layer Thickness Regulating Member | Elastic members which can be brought into pressure contact with the development roller, and the portions where the elastic members come in to contact with the development roller are provided with a resin layer with a negative polarity, such as a resin layer made of fluorine resin. | Elastic members which can be brought into pressure contact with the development roller, and the portions where the elastic members come into contact with the development roller are provided with a resin layer with a positive polarity, such as a resin layer made of silicone resin. |

In order to produce a development roller for which surface is composed of small dielectric portions 20*a* and small electroconductive portions 20*b* which are present in a mixed configuration, for example, a metal roller with grooves formed by double-cut knurling is made. In this case, the grooves are formed with a pitch of 0.1 to 0.5 mm, with an inclination of about 45° with respect to the longitudinal direction of the metal roller as illustrated in FIG. 3(*a*). The surface with such grooves is coated, for example, with a fluorine resin (Trademark "Lumifron LF 200" made by Asahi Glass Co., Ltd.) with a thickness that the grooves are completely filled with the coated fluorine resin as illustrated in FIG. 3(*b*) and the coated fluorine resin is cured and dried at 100° C. for about 30 minutes. Then the surface of the fluorine-resin-coated roller is subjected to machining or polishing in such a manner that the electroconductive portions 20*b* are exposed in the form of small areas mixed with the dielectric portions 20*a*, with the ratio of the total area of the electroconductive portions to the entire surface is in the range of 20 to 60% as illustrated in FIG. 3(*c*).

In the development method of forming micro fields on the development roller, when conventional toners are employed without modification, it is extremely difficult to form two or more toner layers on the development roller in a stable manner. In this case, the toner layer formed on the development roller eventually becomes thin and the amount of the toner used for development decreases, so that the image density decreases or non-uniform development and the fogging of the images occur because of the non-uniformity of the toner layer formed on the development roller. Furthermore, when conventional toners are employed, a thin film of the toner is formed on the development roller, so that the effect of the micro fields is reduced and therefore the toner-holding capability of the development roller is degraded. As a result, it is difficult to supply a sufficient amount of toner for development onto the latent-electrostatic-image-bearing member 10.

By sharp contrast to this, when the toner according to the present invention is employed, the pulverizing of the toner on the development roller 20 is minimized. As a result, the filming of the toner on the development roller 20 is also minimized, so that the effect of the micro fields is sufficiently exhibited and images with high density and high quality can be provided over an extended period of time by the toner according to the present invention.

As mentioned previously, the toner according to the present invention can be employed in the image formation method in which the surface of a developer-bearing member having a chargeable and photoconductive surface is charged, the charged surface is selectively exposed to light to form a number of micro fields near the developer-bearing member, a non-magnetic one-component type developer comprising toner, to which auxiliary agents may be added when necessary, is supplied onto the development roller, the developer is held on the surface of the development roller by the micro fields, and latent electrostatic images are developed to visible images by the developer, which is referred to as the second image formation method.

This image formation method will now be explained in more detail.

Figure 4:
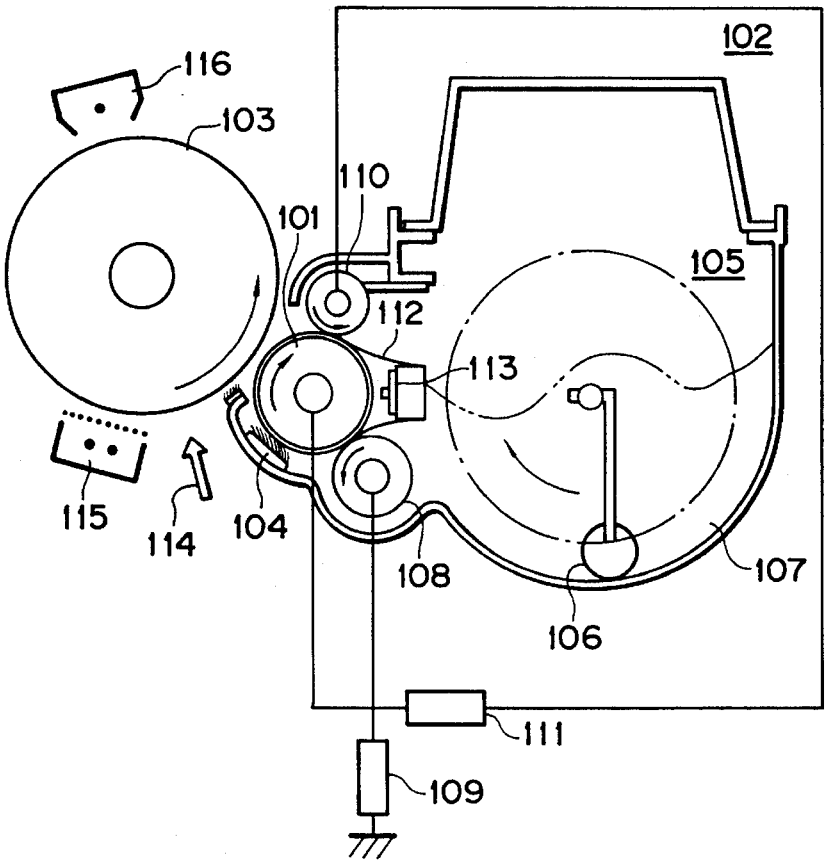
FIG. 4 is a schematic cross-sectional view of a development apparatus including a developer-bearing member (development roller) having a chargeable and photoconductive surface, which is useful to carry out the present invention.

FIG. 4 is a schematic illustration of a development apparatus 102 provided with a developer-bearing member (development roller) 101 having a chargeable and photoconductive surface, which is suitable for carrying out the above-mentioned second image formation method. In this figure, the development apparatus 102 is disposed in close vicinity to a photoconductive drum 103 which bears latent electrostatic images. A blade member 104 for regulating the thickness of a toner layer formed on the development roller 102 is disposed on a downward left side in the figure, in close vicinity to the development roller 101 in such a configuration that the blade member 104 elastically pushes the development roller 101, whereby a toner 107 supplied from a toner tank 105 with the rotation of an agitator 106 is formed into a uniformly thin layer. The agitator 106 is rotated clockwise, so that the toner 107 is moved in the direction of the arrow. On the downward right side of the development roller 101, a toner supply elastic roller 108 for supplying the toner 107 is provided. The toner supply elastic roller 108 is composed of a sponge-like material made of a foamed urethane rubber, or a brush made of the fibers of polyester or polytetrafluoroethylene. The toner supply elastic roller 108 has a function of applying the toner 107 moved by the agitator 106 onto the surface of the development roller 101. The development roller 101 has been precharged by a method which will be mentioned later.

The toner 107 applied by the toner supply roller 108 is charged in a stable manner by the triboelectric charging between the toner supply roller 108 and the development roller 101, so that the toner 107 can be held in a stable manner in the form of a layer on the surface of the development roller 101, although the layer contains a relatively large amount of the toner 107. The toner 107 is formed into a uniform layer with the rotation of the development roller 101 and supplied into a development zone by the blade member 104 which is disposed in elastic pressure contact with the development roller 101. As the blade member 104, a member composed of an elastic cylindrical spring applied with a material having the property of charging the toner, such as urethane rubber, or an elastic member itself, can be employed.

The latent electrostatic images formed on the photoconductor drum 103 are developed with the toner 107, in an amount suitable for the latent electrostatic images, which is determined by a development bias means 109 connected to both the development roller 101 and the toner supply roller 108. The development roller 101 is disposed with a gap of 30 to 500 μm, preferably 50 to 250 μm, from the photoconductor drum 103, in such a configuration that the development roller 101 does not substantially come into contact with the photoconductor drum 103. As a result, an excessive load is unnecessary as in the case where the latent electrostatic images are developed by bringing the development roller into contact with the photoconductor drum, so that it is possible to adopt a small size motor for driving the development roller 101. However, in the case where a flexible belt-shaped photoconductor is employed, the development roller 101 can be disposed in such a configuration as to be in contact with the photoconductor. In this case, the gap between the photoconductor and the development roller 101 corresponds to the thickness of a toner layer held on the surface of the development roller 101. A driving torque can be reduced when the peripheral speed of the photoconductor drum 103 is made substantially equal to that of the development roller 101.

Under the above-mentioned conditions, if a development bias voltage application means 109 is provided, the desired amount of the toner 107 can be transported onto the photoconductor drum 103. The level of the bias potential and the polarity are of course changed, depending upon the choice of normal development or reverse development. For the application of the development bias voltage, an A.C. electric field can be used in combination with a D.C. electric field. In the case where an A.C. electric field is employed, when the frequency of a rectangular wave pulse electric field is set in the range of 300 to 2,000 Hz, preferably in the range of 500 to 1,500 Hz, and the wave form is set in such a manner that the ratio of the time for a high potential portion to the time for a low potential portion differs, high quality images can be obtained, with high sharpness in the portions corresponding to the latent electrostatic images with a low potential, and with high image density in the portions corresponding to the latent electrostatic images with a high potential, without the deposition of the toner on the background. The above-mentioned optimum duty ratio is different, depending upon the polarity of the latent electrostatic images and the polarity of the toner. For example, when latent electrostatic images with a negative polarity are reversely developed with a toner with a negative polarity, it is preferable that the ratio of the time for a high potential portion (−100 V or more) to the time for a low potential portion (−800 V or less) be in the range of 5 to 18:2 to 8. In the case of normal development, when the above ratio is reversed, high quality images can be obtained, with high sharpness in the portions corresponding to the latent electrostatic images with a low potential, and with high image density in the portions corresponding to the latent electrostatic images with a high potential, without the deposition of the toner on the background.

Above the development roller 101, a development roller charging member 110 is disposed in contact with the development roller 101. The charging member 110 is composed of an electroconductive sponge material made of a foamed urethane rubber, or a brush made of fibers, such as polyester fibers or polytetrafluoroethylene fibers in which an electroconductive material is dispersed. The charging member 110 removes the toner remaining on the development roller 101, and applies electric charges to the surface of the development roller 101 through a power source 111. The toner removed from the surface of the development roller 101 is recovered by a scraper 112 and used once again. As the charging member 110, any device can be used as long as it can apply charges to the development roller 101. For instance, a corona charging device can be employed as the charging member 110. As the power source 111, a power source which superimposes A.C. on D.C. can also be employed. In the development apparatus as shown in FIG. 4, the voltage applied to the development roller 101 is in the range of 50 to 500 V, preferably in the range of 100 to 300 V. Thus, the voltage applied by the power source 111 is in the range of 300 to 2,000 V, preferably in the range of 500 to 1,000 V.

On the right side of the development roller 101, a light projection member 113 comprising, for example, an LED array element, which serves as a micro point light source, is disposed. By the light projection member 113, the electric charges on the development roller 101 are erased in a desired pattern. As a result, a number of minute charged portions and minute non-charged portions are formed on the surface of the development roller 101, so that a number of closed micro fields are formed on the surface of the development roller 101. These electric fields bring about the so-called "edge effect" on the entire surface of the development roller 101, whereby the toner attracting force of the development roller 101 is significantly increased in comparison with the case where a uniform electric field is merely formed on the surface of the development roller 101. Generally the increasing ratio is in the range of 1.5 to 2 times the case where a uniform electric field is merely formed on the surface of the development roller 101. Accordingly, the toner deposition is increased in accordance with this ratio. By the above-mentioned steps, the toner 107 moved by the agitator 106 is stably charged by the holding force of the electric charges held by the development roller 101 and the triboelectric charging effect generated by the friction between the toner supply roller 108 and the development roller 101. The toner layer formed on the development roller 101 is held in a stable manner although the toner layer contains a relatively large amount of the toner. Generally the so-called thin layer of a non-magnetic toner contains the toner in an amount of 0.2 to 0.4 mg/cm$^2$ on the development roller 101, while the so-called multiple layer contains about 0.5 mg/cm$^2$ or more, usually 0.8 to 1.2 mg/cm$^2$, on the development roller 101. In FIG. 4, reference numeral 114 indicates an exposure light beam for the formation of latent electrostatic images on the photoconductor drum 103; reference numeral 115, a corona charger; and reference numeral 116, a charger for image transfer.

Figure 5:
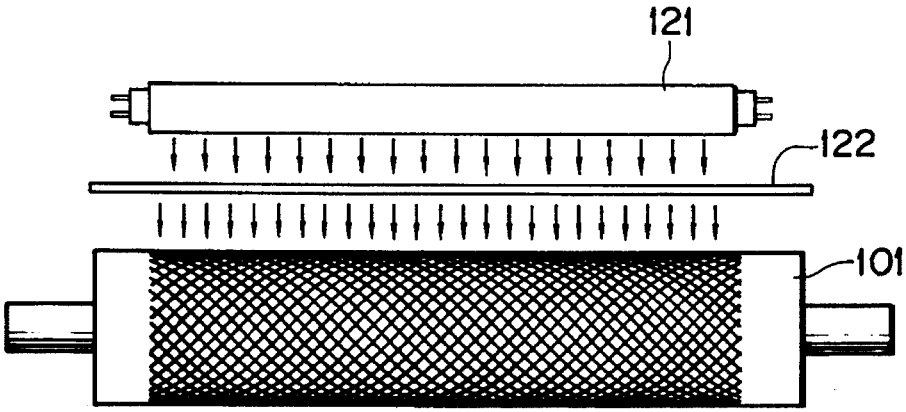
FIG. 5 is a schematic cross-sectional view of a system for erasing the electric charges in a desired pattern on the development roller by use of a cold cathode tube light source.

FIG. 5 schematically shows another method of erasing electric charges on the development roller 101 in the desired pattern. In this method, the illumination light from a cold cathode tube light source 121 is applied through a micro-field-printed transparent film 122 to the development roller 101 in sychronism with the rotation of the development roller 101. On the transparent film 122, since the micro fields are printed in zigzag patterns, the corresponding zigzag patterns are formed on the surface of the development roller 101.

Figure 6:
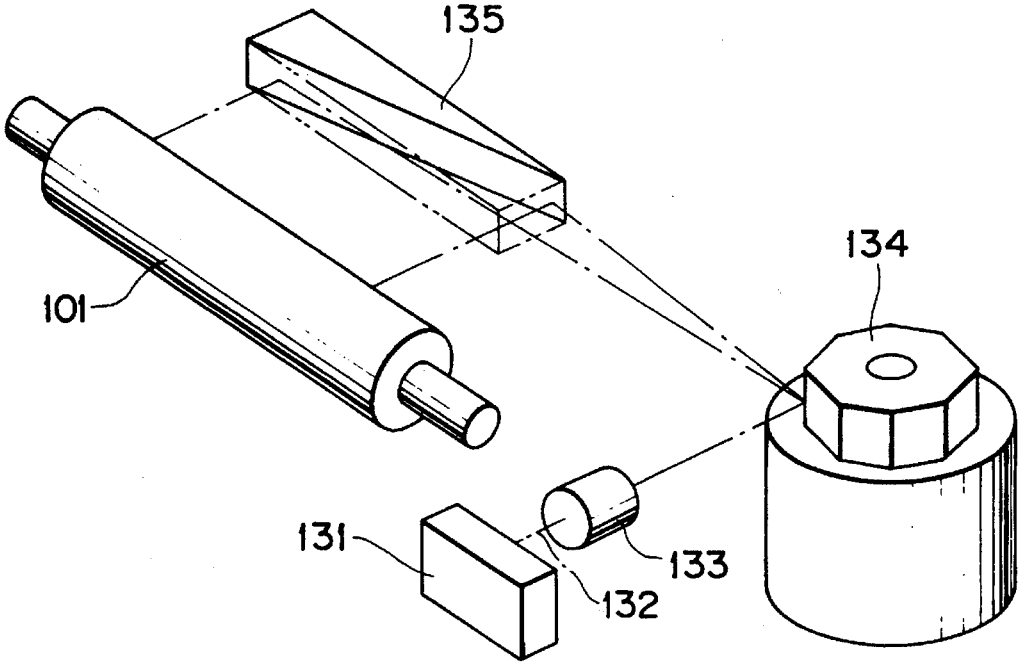
FIG. 6 is a schematic perspective view of a system for erasing the electric charges in a desired pattern on the development roller by use of a semiconductor laser light source.

FIG. 6 schematically shows a further method of erasing electric charges on the development roller 101 in the desired pattern. The laser beam emitted from semiconductor laser light source 131 is changed to a laser beam with a predetermined diameter by collimator lens 133, and the direction of the laser beam is changed by a rotary polygonal mirror 134. The laser beam then scans the development roller 101 by a reflecting mirror 135 such a prism. Thus, the desired micro fields can be formed on the surface of the development roller 101 by the laser beam projected thereto.

The surface of the development roller 101 is made of a material which is both chargeable and phtoconductive. As such a material, any materials used as photoconductors used in electrophotography can be generally employed. Examples of such materials include inorganic photoconductive materials such as Se, Pb, Cd, Zn and Si, and materials comprising such inorganic photoconductive materials dispersed in binder resins; organic photoconductive materials such as cyclic carbon compounds, heterocyclic compounds, pigments, dyes, azo compounds, phthalocyanine compounds, arylamine and arylmethane compounds; polymeric phtoconductive material such as polyvinyl carbazol derivatives; and mixtures of the above photoconductive materials. Amorphous silicon photoconductors are preferable in view of the resistance to abrasion; and organic photoconductors and dispersed type inorganic photoconductors using, for example, zinc oxide, are preferable in view of the cost and performance.

By constructing the development roller 101 as mentioned above, a sufficient amount of stably charged toner can be held in a stable manner on the development roller 101, so that even if the photoconductor and the development roller 101 are rotated at the same speed, the reduction in image density does not occur.

The features of this invention will become apparent in the course of the following description of exemplary embodiments which are given for illustration of the invention and are not intended to be limiting thereof.

EXAMPLE 1

A mixture of the following components was kneaded under application of heat. The mixture was then cooled and ground by a hammer mill, followed by pulverizing by an air-jet type pulverizer.

| | Parts by Weight |
|---|---|
| Styrene-acryl copolymer (Binder resin) | 95 |
| Low-molecular weight polypropylene (Lubricant) | 5 |
| Carbon black (coloring agent) | 10 |
| Zinc salt of salicylic acid derivative (Charge controlling agent) | 4 |

The pulverized mixture was then classified to obtain finely-divided particles with an average particle size of 11 μm. 100 parts by weight of the above finely-divided particles and 0.4 parts by weight of finely-divided particles of silica were mixed to obtain toner No. 1 according to the present invention.

The aggregation degree of toner No. 1 was 22%. This toner was incorporated in the previously mentioned development apparatus, and a D.C. potential of 500 V was applied to the development roller, whereby the Q/M of the toner on the development roller was measured by the suction method. The result was that the Q/M was −14.2 μC/g.

This toner was then incorporated in a development apparatus provided with a development roller having a cross section as shown in FIG. 3(*c*) and a surface as shown in FIG. 3(*a*) including small dielectric portions and small electroconductive portions in a mixed configuration on the surface thereof, with the area ratio of the dielectric portions being 50%, and image formation was carried out. The result was that clear images with high density and free from the deposition of the toner on the background were obtained.

5000 copies were then continuously made. Clear images were obtained throughout the copying process, without causing toner filming on the development roller.

EXAMPLE 2

A mixture of the following components was kneaded under application of heat. The mixture was then cooled and ground by a hammer mill, followed by pulverizing by an air-jet type pulverizer.

| | Parts by Weight |
|---|---|
| Styrene-acryl copolymer (Binder resin) | 95 |
| Low-molecular weight polypropylene (Lubricant) | 5 |
| Carbon black (coloring agent) | 7 |
| Nigrosine dye (Charge controlling agent) | 3 |

The pulverized mixture was then classified to obtain finely-divided particles with an average particle size of 12 μm. 100 parts by weight of the above finely-divided particles and 0.6 parts by weight of finely-divided particles of titanium oxide were mixed to obtain toner No. 2 according to the present invention.

The aggregation degree of toner No. 2 was 15%. This toner was incorporated in the previously mentioned development apparatus, and a D.C. potential of −250 V was applied to the development roller, whereby the Q/M of the toner on the development roller was measured by the suction method. The result was that the Q/M was +9.5 μC/g.

This toner was then incorporated in a development apparatus provided with a development roller having a cross section as shown in FIG. 3(*c*) and a surface as shown in FIG. 3(*a*) including small dielectric portions and small electroconductive portions in a mixed configuration on the surface thereof, with the area ratio of the dielectric portions being 40%, and image formation was carried out. The result was that clear images with high density and free from the deposition of the toner on the background were obtained.

5000 copies were then continuously made. Clear images were obtained throughout the copying process, without causing toner filming on the development roller.

EXAMPLE 3

A mixture of the following components was kneaded under application of heat. The mixture was then cooled and ground by a hammer mill, followed by pulverizing by an air-jet type pulverizer.

| | Parts by Weight |
|---|---|
| Polyester resin (Binder resin) | 95 |
| Low-molecular weight wax (Lubricant) | 5 |
| Carbon black (coloring agent) | 10 |
| Zinc salt of salicylic acid derivative (Charge controlling agent) | 4 |

The pulverized mixture was then classified to obtain finely-divided particles with an average particle size of 8 μm. 100 parts by weight of the above finely-divided particles and 0.5 parts by weight of finely-divided particles of silica were mixed to obtain toner No. 3 according to the present invention.

The aggregation degree of toner No. 3 was 50%. This toner was incorporated in the previously mentioned development apparatus, and a D.C. potential of 500 V was applied to the development roller, whereby the Q/M of the toner on the development roller was measured by the suction method. The result was that the Q/M was −25 μC/g.

This toner was then incorporated in a development apparatus provided with a development roller having a cross section as shown in FIG. 3(*c*) and a surface as shown in FIG. 3(*a*) including small dielectric portions and small electroconductive portions in a mixed configuration on the surface thereof, with the area ratio of the dielectric portions being 50%, and image formation was carried out. The result was that clear images with high density and free from the deposition of the toner on the background were obtained.

5000 copies were then continuously made. Clear images were obtained throughout the copying process, without causing toner filming on the development roller.

COMPARATIVE EXAMPLE 1

The procedure for Example 1 was repeated except that the amount of the finely-divided silica particles employed in Example 1 was decreased to 0.05 parts, whereby comparative toner No. 1 was prepared.

The aggregation ratio of comparative toner No. 1 was 65%. The Q/M of the comparative toner was measured in the same manner as in Example 1. The result was that the Q/M of comparative toner No. 1 was −9.4 μC/g.

Image formation was made by use of this comparative toner in the same manner as in Example 1. The result was that the obtained image density was low and non-uniform from place to place.

COMPARATIVE EXAMPLE 2

The procedure for Example 1 was repeated except that the amount of the charge controlling agent employed in Example 1 was decreased to 1.0 part, whereby comparative toner No. 2 was prepared.

The aggregation ratio of comparative toner No. 2 was 24%. The Q/M of the comparative toner was measured in the same manner as in Example 1. The result was that the Q/M of comparative toner No. 2 was −1.5 μC/g.

Image formation was made by use of this comparative toner in the same manner as in Example 1. The result was that the deposition of the toner on the background was observed and the line images were not clear and blurred.

COMPARATIVE EXAMPLE 3

A mixture of the following components was kneaded under application of heat. The mixture was then cooled and ground by a hammer mill, followed by pulverizing by an air-jet type pulverizer.

| | Parts by Weight |
|---|---|
| Polystyrene (Binder resin) | 95 |
| Low-molecular weight polypropylene (Lubricant) | 5 |
| Carbon black (coloring agent) | 5 |
| Zinc salt of salicylic acid derivative (Charge controlling agent) | 6 |

The pulverized mixture was then classified to obtain finely-divided particles with an average particle size of 7.5 μm. 100 parts by weight of the above finely-divided particles and 0.4 parts by weight of finely-divided particles of silica were mixed to obtain comparative toner No. 3.

The aggregation degree of comparative toner No. 3 was 62%. The Q/M of the comparative toner was measured in the same manner as in Example 1. The result was that the Q/M of comparative toner No. 3 was −31.5 μC/g.

Image formation was made by use of this comparative toner in the same manner as in Example 1. The result was that the obtained image density was low and non-uniform from place to place.

COMPARATIVE EXAMPLE 4

The procedure for Example 2 was repeated except that the amount of the titanium oxide employed in Example 2 was increased to 2.0 parts, whereby comparative toner No. 4 was prepared.

The aggregation ratio of comparative toner No. 4 was 4%. The Q/M of the comparative toner was measured in the same manner as in Example 1. The result was that the Q/M of comparative toner No. 4 was +7.6 μC/g.

Image formation was made by use of this comparative toner in the same manner as in Example 2. The result was that the deposition of the toner on the background was observed and the line images were not clear and blurred.

The results of the evaluation of toners No. 1 to No. 3 according to the present invention and comparative toners No. 1 to No. 4 are summarized in the following TABLE 1:

TABLE 1

| | Aggregation Degree of Toner (%) | Q/M (μC/g) of Toner by Suction Method | Image Density (*) | Unevenness of Image Density | Toner Deposition or Image Blur |
|---|---|---|---|---|---|
| Ex. | | | | | |
| 1 | 22 | −14.2 | 1.40 | null | null |
| 2 | 15 | +9.5 | 1.42 | null | null |
| 3 | 50 | −25.0 | 1.42 | null | null |
| Comp. Ex. | | | | | |
| 1 | 65 | −9.4 | 0.95 | observed | null |
| 2 | 24 | −1.5 | 1.32 | null | observed |
| 3 | 62 | −31.5 | 0.91 | observed | null |
| 4 | 4 | +7.6 | 1.30 | null | observed |

(*)The image density was measured by a commercially available densitometer made by Mcbeth Co., Ltd.

EXAMPLE 4

A mixture of the following components was kneaded under application of heat. The mixture was then cooled and ground by a hammer mill, followed by pulverizing by an air-jet type pulverizer.

| | Parts by Weight |
|---|---|
| Styrene-acryl copolymer (Binder resin) | 95 |
| Low-molecular weight polypropylene (Lubricant) | 5 |
| Carbon black (coloring agent) | 10 |
| Zinc salt of salicylic acid derivative (Charge controlling agent) | 4 |

The pulverized mixture was then classified to obtain finely-divided particles with an average particle size of 11 μm. 100 parts by weight of the above finely-divided particles and 0.4 parts by weight of finely-divided particles of $SiO_2$ were mixed to obtain toner No. 4 according to the present invention.

The aggregation degree of toner No. 4 was 16%, and the specific volume resistivity of toner No. 4 was 11.2 log Ω. cm.

This toner was incorporated in the development apparatus as shown in FIG. 4, and the Q/M of the toner on the development roller was measured by the suction method. The result was that the Q/M was −10.8 μC/g.

The development roller shown in FIG. 5 was incorporated into the development apparatus as shown in FIG. 4. The above toner was incorporated in this development apparatus and the development roller and the photoconductor were rotated at the same speed, and a reverse development was carried out. As a result, clear images with high density, free from the toner deposition on the background and the fogging were obtained. In this case, the potential of the charged portions on the photoconductor was −800 V, and the potential of the exposed portions on the photoconductor was −100 V, and the toner was deposited on the exposed portions for development of latent electrostatic images.

Normal images were obtained under high temperatures and humidities. Even when 3,000 copies were continuously made, the obtained image quality was the same in the first copy and the 3000th copy.

COMPARATIVE EXAMPLE 5

The procedure for Example 4 was repeated except that the amount of the finely-divided $SiO_2$ particles employed in Example 1 was decreased to 0.1 parts, whereby comparative toner No. 3 was prepared.

The aggregation degree of comparative toner No. 5 was 43%, and the specific volume resistivity of the toner was 11.1 log Ω·cm. The Q/M of the comparative toner was measured in the same manner as in Example 1. The result was that the Q/M of comparative toner No. 5 was −10.0 μC/g.

Image formation was made by use of this comparative toner and the obtained images were evaluated in the same manner as in Example 4. The result was that the obtained image density was low and non-uniform from place to place.

COMPARATIVE EXAMPLE 6

The procedure for Example 4 was repeated except that the amount of the charge controlling agent employed in Example 1 was decreased to 1.5 parts, whereby comparative toner No. 6 was prepared.

The aggregation degree of comparative toner No. 6 was 20%, and the specific volume resistivity of the comparative toner was 11.3 log Ω·cm. The Q/M of the comparative toner was measured in the same manner as in Example 1. The result was that the Q/M of comparative toner No. 6 was −2.2 μC/g.

Image formation was made by use of this comparative toner and the obtained images were evaluated in the same manner as in Example 4. The result was that the deposition of the toner on the background was observed and the line images were not clear and blurred.

COMPARATIVE EXAMPLE 7

A mixture of the following components was kneaded under application of heat. The mixture was then cooled and ground by a hammer mill, followed by pulverizing by an air-jet type pulverizer.

| | Parts by Weight |
|---|---|
| Polystyrene (Binder resin) | 95 |
| Low-molecular weight polypropylene (Lubricant) | 5 |
| Carbon black (coloring agent) | 5 |
| Zinc salt of salicylic acid derivative (Charge controlling agent) | 6 |

The pulverized mixture was then classified to obtain finely-divided particles with an average particle size of 9 μm. 100 parts by weight of the above finely-divided particles and 0.4 parts by weight of finely-divided particles of $SiO_2$ were mixed to obtain comparative toner No. 7.

The aggregation degree of comparative toner No. 7 was 29%, and the specific volume resistivity of toner No. 7 was 11.51 log Ω·cm.

The Q/M of this comparative toner was measured in the same manner as in Example 4. The result is that the Q/M of the toner was −28.0 μC/g.

Image formation was made by use of this comparative toner and the obtained images were evaluated in the same manner as in Example 4. The result is that the obtained image density was low and non-uniform from place to place.

COMPARATIVE EXAMPLE 8

A mixture of the following components was kneaded under application of heat. The mixture was then cooled and ground by a hammer mill, followed by pulverizing by an air-jet type pulverizer.

| | Parts by Weight |
|---|---|
| Styrene - methylacrylate copolymer (Binder resin) | 50 |
| Polyester resin (Binder resin) | 45 |
| Low-molecular weight polypropylene (Lubricant) | 5 |
| Carbon black (coloring agent) | 15 |
| Zinc salt of salicylic acid derivative (Charge controlling agent) | 3 |

The pulverized mixture was then classified to obtain finely-divided particles with an average particle size of 10 μm. 100 parts by weight of the above finely-divided particles and 0.4 parts by weight of finely-divided particles of $SiO_2$ were mixed to obtain comparative toner No. 8.

The aggregation degree of comparative toner No. 8 was 19%, and the specific volume resistivity of toner No. 8 was 10.01 log Ω·cm.

The Q/M of this comparative toner was measured in the same manner as in Example 1. The result is that the Q/M of the toner was −7.2 μC/g.

Image formation was made by use of this comparative toner and the obtained images were evaluated in the same manner as in Example 4. The result was that black spots appeared in the images because there was the leakage of electric charges between the development roller and the photoconductor, and under the conditions of high temperatures and humidities, the transfer of the images became poor, and the deposition of the toner on the background occurred. Furthermore, the obtained image density was non-uniform.

COMPARATIVE EXAMPLE 9

A mixture of the following components was kneaded under application of heat. The mixture was then cooled and ground by a hammer mill, followed by pulverizing by an air-jet type pulverizer.

| | Parts by Weight |
|---|---|
| Polystyrene resin (Binder resin) | 95 |
| Low-molecular weight polypropylene (Lubricant) | 5 |
| Carbon black (coloring agent) | 5 |
| Zinc salt of salicylic acid derivative (Charge controlling agent) | 3 |

The pulverized mixture was then classified to obtain finely-divided particles with an average particle size of 12 μm. 100 parts by weight of the above finely-divided particles and 0.3 parts by weight of finely-divided particles of $SiO_2$ were mixed to obtain comparative toner No. 9.

The aggregation degree of comparative toner No. 9 was 27%, and the specific volume resistivity of toner No. 9 was 11.85 log Ω·cm.

The Q/M of this comparative toner was measured in the same manner as in Example 1. The result was that the Q/M of the toner was −15.6 μC/g.

This comparative toner was incorporated in the development apparatus as employed in Example 1 and image formation was made. The obtained images were evaluated in the same manner as in Example 4. The result was that there was no problem before 1000 copies, but after 1000 copies, the image density began to decrease.

EXAMPLE 5

A mixture of the following components was kneaded under application of heat. The mixture was then cooled and ground by a hammer mill, followed by pulverizing by an air-jet type pulverizer.

| | Parts by Weight |
|---|---|
| Styrene-acryl copolymer (Binder resin) | 95 |
| Low-molecular weight polypropylene (Lubricant) | 5 |
| Carbon black (coloring agent) | 6 |
| Nigrosine dye (Charge controlling agent) | 6 |

The pulverized mixture was then classified to obtain finely-divided particles with an average particle size of 12 μm. 100 parts by weight of the above finely-divided particles and 0.6 parts by weight of finely-divided particles of $TiO_2$ were mixed to obtain toner No. 5 according to the present invention.

The aggregation degree of toner No. 5 was 13%, and the specific volume resistivity of the toner was 11.41 log Ω·cm. This toner was incorporated in the previously mentioned development apparatus, and the Q/M of the toner on the development roller was measured by the suction method. The result was that the Q/M was +14.0 μC/g.

This toner was then incorporated in the same development apparatus as employed in Example 4, and development of latent electrostatic images was carried out by rotating the development roller and the photoconductor at the same speed. As a result, clear images with high density, free from the toner deposition on the background and the fogging of the images, were obtained. In this case, the potential of the charged portions on the photoconductor was −800 V, and the potential of the exposed portions was −100 V, and the toner was deposited on the charged portions.

Under high temperatures and humidities, no abnormal images were formed. The image quality was not changed throughout the process of continuously making 3,000 copies.

COMPARATIVE EXAMPLE 10

The procedure for Example 5 was repeated except that the amount of the finely-divided particles of $TiO_2$ employed in Example 5 was increased to 2.0 parts, whereby comparative toner No. 10 was prepared.

The aggregation degree of comparative toner No. 10 was 4%, and the specific volume resistivity of the comparative toner was 11.01 log Ω·cm. The Q/M of the comparative toner was measured in the same manner as in Example 1. The result was that the Q/M of comparative toner No. 10 was +9.6 μC/g.

Image formation was made by use of this comparative toner and the obtained images were evaluated in the same manner as in Example 5. The result was that the deposition of the toner on the background was observed and the line images were not clear and blurred.

The results of the above-mentioned evaluation of Examples 4 to 5, and Comparative Examples 5 to 10 are summarized in the following TABLE 2:

TABLE 2

| | Aggregation Degree of Toner (%) | Specific Volume Resistivity (logΩcm) | Q/M (μC/g) of Toner by Suction Method | Image Density (*) Initial Stage | After making 1000 copies | After making 3000 copies | Initial Stage 30° C. 90% RH | Unevenness of Image Density | Black Spots | Toner Deposition or Image Blur |
|---|---|---|---|---|---|---|---|---|---|---|
| Ex. | | | | | | | | | | |
| 4 | 16 | 11.2 | −10.8 | 1.40 | 1.38 | 1.38 | 1.37 | null | null | null |
| 5 | 13 | 11.4 | +14.0 | 1.38 | 1.37 | 1.36 | 1.38 | null | null | null |
| Comp. Ex. | | | | | | | | | | |
| 5 | 43 | 11.1 | −10.0 | 0.89 | — | — | — | considerably observed | null | null |
| 6 | 20 | 11.3 | −2.2 | 1.24 | 1.11 | — | 1.19 | same as above | null | considerably observed |
| 7 | 29 | 11.5 | −28.0 | 0.84 | — | — | — | same as above | null | null |
| 8 | 19 | 10.0 | −7.2 | 1.32 | 1.18 | 1.09 | 0.86 | slightly observed | considerably observed | slightly observed |
| 9 | 27 | 11.85 | −15.6 | 1.24 | 0.92 | — | 1.15 | same as above | null | null |
| 10 | 4 | 11.0 | +9.6 | 1.27 | — | — | — | null | null | considerably observed |

(*)The image density was measured by a commercially available densitometer made by Mcbeth Co., Ltd.

What is claimed is:

1. A method of developing latent electrostatic images, comprising the steps of (a) charging the surface of a developer-bearing member having a chargeable and photoconductive surface, (b) selectively exposing the charged surface to light for forming a number of micro fields near the developer-bearing member, (c) supplying, onto the developer-bearing member, a non-magnetic one-component type developer comprising a toner comprising a binder resin and a coloring agent, with an aggregation degree of 5 to 30%, and an absolute value of Q/M measured by the suction method of 5 to 20 μC/g, and having a specific volume resistivity in the range of 10.2 to 11.8 log Ω·cm, to which auxiliary agents may be added when necessary, (d) holding the developer on the surface of the developer-bearing member by the microfields, and (e) developing latent electrostatic images to visible images by the developer.

2. A toner comprising a binder resin and a coloring agent, with an aggregation degree of 5 to 30%, and an absolute value of Q/M measured by the suction method of 5 to 20 μC/g, and having a specific volume resistivity in the range of 10.2 to 11.8 log Ω·cm, for use in an image formation method in which (a) the surface of a developer-bearing member having a chargeable and photoconductive surface is charged, (b) the charged surface is selectively exposed to light for forming a number of micro fields near the developer-bearing member, (c) a non-magnetic one-component type developer comprising said toner, to which auxiliary agents may be added when necessary, is supplied onto the developer-bearing member, (d) the developer is held on the surface of the developer-bearing member by the microfields, and (e) latent electrostatic images are developed to visible images by the developer.

3. A toner as claimed in claim 2 in the form of a multiple layer on a developer roller in an amount of at least about 0.5 $mg/cm^2$.

4. A toner as claimed in claim 3, wherein said amount is between 0.8 and 1.2 $mg/cm^2$.

* * * * *